US007614327B2

(12) United States Patent
Schlüsselbauer

(10) Patent No.: US 7,614,327 B2
(45) Date of Patent: Nov. 10, 2009

(54) DEVICE FOR PROCESSING THE CONTACT SURFACE OF A MOLD PROFILE, WHICH FORMS A NEGATIVE MOLD FOR A SHAFT FLOOR DRAIN AND IS POSSIBLY ASSEMBLED FROM PROFILE PARTS, MADE OF THERMOPLASTIC FOAM

(76) Inventor: Johann Schlüsselbauer, Hörbach 4, A 4673 Gaspoltshofen (AT)

( * ) Notice: Subject to any disclaimer, the term of this patent is extended or adjusted under 35 U.S.C. 154(b) by 351 days.

(21) Appl. No.: 11/506,065

(22) Filed: Aug. 17, 2006

(65) Prior Publication Data

US 2007/0042071 A1 Feb. 22, 2007

(30) Foreign Application Priority Data

Aug. 17, 2005 (AT) ..... A 1379/2005

(51) Int. Cl.
*B26D 7/10* (2006.01)

(52) U.S. Cl. ..... 83/171; 83/651.1

(58) Field of Classification Search ..... 83/651.1, 83/171, 810–812; 425/193; 264/46.5, 655, 264/678

See application file for complete search history.

(56) References Cited

U.S. PATENT DOCUMENTS 411,690 A * 9/1889 Somerville ..... 83/651.1
2,464,718 A * 3/1949 Potter et al. ..... 83/171
2,972,669 A * 2/1961 Brown ..... 83/171
3,018,355 A * 1/1962 Wallerstein ..... 83/171
3,259,155 A * 7/1966 Kawabata ..... 83/13
3,986,416 A * 10/1976 Wade ..... 83/171
4,683,792 A * 8/1987 Demont ..... 83/171
5,191,824 A 3/1993 Rathbun, Jr.
5,320,016 A * 6/1994 Spath et al. ..... 83/801
5,666,872 A * 9/1997 McDonald et al. ..... 83/651.1
2005/0233022 A1 * 10/2005 Schlusselbauer ..... 425/193

* cited by examiner

*Primary Examiner*—Stephen Choi
(74) *Attorney, Agent, or Firm*—Collard & Roe, P.C.

(57) ABSTRACT

A device for processing the contact surface of a mold profile has a table for receiving the mold profile and a heating wire running in accordance with the cross-sectional profile of the contact surface to be produced, which is movable in relation to the table along the contact surface. The mold profile is rotatable around the receptacle axis coaxially to the table receiving the contact surface in relation to the heating wire, which, originating from the receptacle axis, runs diagonally in relation to the receptacle axis at an angle corresponding to the conical contact surface to be processed, and the table has a passage for the heating wire to be inserted into the processing allowance of the mold profile in relation to the table in the direction of the receptacle axis.

8 Claims, 4 Drawing Sheets

DEVICE FOR PROCESSING THE CONTACT SURFACE OF A MOLD PROFILE, WHICH FORMS A NEGATIVE MOLD FOR A SHAFT FLOOR DRAIN AND IS POSSIBLY ASSEMBLED FROM PROFILE PARTS, MADE OF THERMOPLASTIC FOAM

CROSS REFERENCE TO RELATED APPLICATIONS

Applicant claims priority under 35 U.S.C. §119 of Austrian Application No. A 1379/2005 filed Aug. 17, 2005.

FIELD OF INVENTION

The present invention relates to a device for processing the contact surface of a mold profile, which forms a negative mold for a shaft floor drain and is possibly assembled from profile parts, made of thermoplastic foam, which is provided with a processing allowance in the area of the contact surface, having a table for receiving the mold profile to be processed and having a heating wire running in accordance with the cross-sectional profile of the contact surface to be produced, which is movable in relation to the table along the contact surface to be processed.

DESCRIPTION OF THE PRIOR ART

Since the drains of shafts are generally to be adapted to the local conditions of a construction site, the shaft floors are frequently manufactured having a crude floor without a drain in a mold comprising a pot-like core and a mantle, so that the drain may subsequently be molded by hand in accordance with the particular sewer guiding. To avoid the disadvantages connected to such hand manufacturing, at least the typically linear drain branches, which discharge into the main drain, may be manufactured with the aid of profile parts, which are attached as the negative mold of the drain branch to the floor of the mold core and adjoin the extruded profile for the main drain formed by the mold core. Especially simple construction conditions result if the extruded profile for the main drain is assembled from linear sections and sections in the shape of a circular arc and is also attached to the floor of the mold core, because in this case the extruded profile for the main drain may also be adapted to the local conditions. However, it must be ensured that the front connection faces of the profile parts for the drain branches are processed in accordance with the profile cross-section and the axial curve of the extruded profile for the main drain, which is connected to a significant processing outlay under certain circumstances because of the required different curvatures of these connection faces. To avoid this work outlay, it has already been suggested that the profile parts for the drain branches be manufactured from thermoplastic in order to cut the connection faces of these profile parts using a heating wire shaped in accordance with the outline curve of the extruded profile for the main drain, which is moved along a path corresponding to the axial curve of the extruded profile for the main drain in relation to the oriented profile part, it being ensured that the plane of the heating wire is always oriented perpendicular to the axial curve of the extruded profile for the main drain. In this case, the heating wire passes over an envelope surface which corresponds to the surface of the extruded profile in the connection area of the drain branch. The mold profile for the shaft floor drain may therefore be assembled comparatively simply from an extruded profile for the main drain and profile parts for the drain branches connected to this extruded profile in a formfitting way. The mold profile prepared in this way for the floor of the mold core accommodating the shaft floor drain, which forms the later step surface of the shaft floor, has a flat contact surface for the mold profile for this purpose, which possibly sinks toward the drain outlet. Such flat step surfaces of the shaft floor are accompanied by the danger that wastewater residues on the step surface will not drain off to the shaft floor drain, however. For this reason, the step surfaces of shaft floors are implemented as conical, so that wastewater residues drain toward the floor middle to the drain. To implement such conical step surfaces, the mold core solely has to be provided with a corresponding conical floor. A conical core floor causes difficulties, however, if a mold profile resulting in the negative mold of the later drain is to be placed on the floor of the mold core.

SUMMARY OF THE INVENTION

The present invention is thus based on the object of implementing a device for processing the contact surface of a mold profile made of thermoplastic foam of the type described at the beginning in such a way that, using simple means, a contact surface of the mold profile corresponding to the conical floor surface of the mold core is obtained.

The present invention achieves this object in that the mold profile is rotatable coaxially to the table accommodating the contact surface around the receptacle axis in relation to the heating wire, which, originating from the receptacle axis, runs diagonally at an angle corresponding to the conical contact surface to be processed in relation to the receptacle axis, and the table has a passage for the wire to be inserted into the processing allowance of the mold profile in the direction of the receptacle axis in relation to the table.

Since a conical surface has linear generating functions, such a conical surface may be processed by a linear heating wire which is rotated around the axis of the conical surface in relation to the workpiece made of thermoplastic foam. However, the difficulty results in the mold profiles to be processed that the contact surface of these mold profiles may only be received by a table in a precise position, so that the surface to be processed is not freely accessible. For this reason, the table is provided with a passage for the heating wire, which is displaceable in relation to the table in the direction of the receptacle axis of the mold profile corresponding to the conical axis, which must thus be inserted into the processing allowance of the mold profile before the processing of the contact surface through a relative rotation of the heating wire in relation to the table in the direction of the receptacle axis, in order to achieve a predefined starting position for the actual processing of the contact surface. Since only slight peripheral forces must be exerted on the mold profile because of the melting procedure during the relative rotation of the heating wire in relation to the mold profile, no separate holder of the mold profile during the processing of the contact surface is necessary. It is only to be ensured that the mold profile is attached to the table oriented in relation to the rotational axis of the table, so that the receptacle axis runs coaxially to the rotational axis of the contact surface.

Although there is solely a relative rotation between the table and the heating wire, especially simple construction conditions result if the table is mounted in a frame so it is rotatable in relation to the heating wire, which is held rotationally fixed, because in this case no arrangements have to be made to supply current to a rotating part. Similar advantages result if the table is adjusted in height in the direction of the receptacle axis in relation to the heating wire in the frame via a lift unit, because the heating wire may again be situated fixed on the frame.

In order to be able to perform the processing of the contact surface of the mold profile in a comparatively short processing time, the heating wire may have two branches, which are symmetrical to the receptacle axis, on diametrically opposite sides of the receptacle axis, so that a relative rotation of 180° is sufficient for complete processing of the contact surface. The heating wire may be supported easily via a mandrel coaxial to the receptacle axis, especially simple electrical connection conditions resulting because the heating wire ends are freely accessible. In general, the heat output of the heating wire guided over the mandrel is sufficient to ensure the insertion of the heating wire into the processing allowance of the mold profile even in the area of the mandrel support. If a greater penetration resistance of the mandrel is feared in the area of the partition line melted by the heating wire, the tip of the mandrel may additionally be enclosed with a heating wire clip running transversely to the heating wire to support the heating wire, which ensures an expansion of the partition line in the area of the mandrel. Finally, the mandrel may be adjusted in the direction of the receptacle axis to set the cone angle of the step surface of the shaft floor, so that the angle of inclination of the heating wire branches changes correspondingly with the adjustment of the mandrel.

In general, the drain outlets are lower than the drain inlets. This may be taken into consideration by a corresponding inclination of the cone axis of the step surface in relation to the drain outlet. Such an additionally inclined step surface of the shaft floor requires a correspondingly inclined, conical floor surface of the mold core, which in turn requires an adaptation of the contact surface of the mold profile. For this purpose, the table may be mounted so it is adjustable by pivoting around a transverse axis to the receptacle axis, so that via the pivot adjustment of the table, the additional inclination of the conical step surface of the shaft floor may be tracked. Because of the inclination of the receptacle axis, however, the receptacle axis no longer corresponds to the rotational axis of the table.

In order that the mold profile may be tailored to the diameter of the cylindrical mold core, it may be ensured by at least one additional heating wire running parallel to the receptacle axis, which is held in a carrier, which is adjustable radially to the receptacle axis on the table and mounted so it is rotatable in relation to the table around the receptacle axis, that the outer front faces of the mold profile lie in a cylindrical envelope surface corresponding to the diameter of the mold core. If a heating wire having branches lying on diametrically opposite sides of the receptacle axis is provided, it is suggested that two heating wires which are also diametrically opposite in relation to the receptacle axis be provided in order to be able to achieve complete processing of the mold profile using half a table revolution.

BRIEF DESCRIPTION OF THE DRAWING

The object of the present invention is illustrated as an example in the drawing.

DESCRIPTION OF THE PREFERRED EMBODIMENTS

Figure 1:
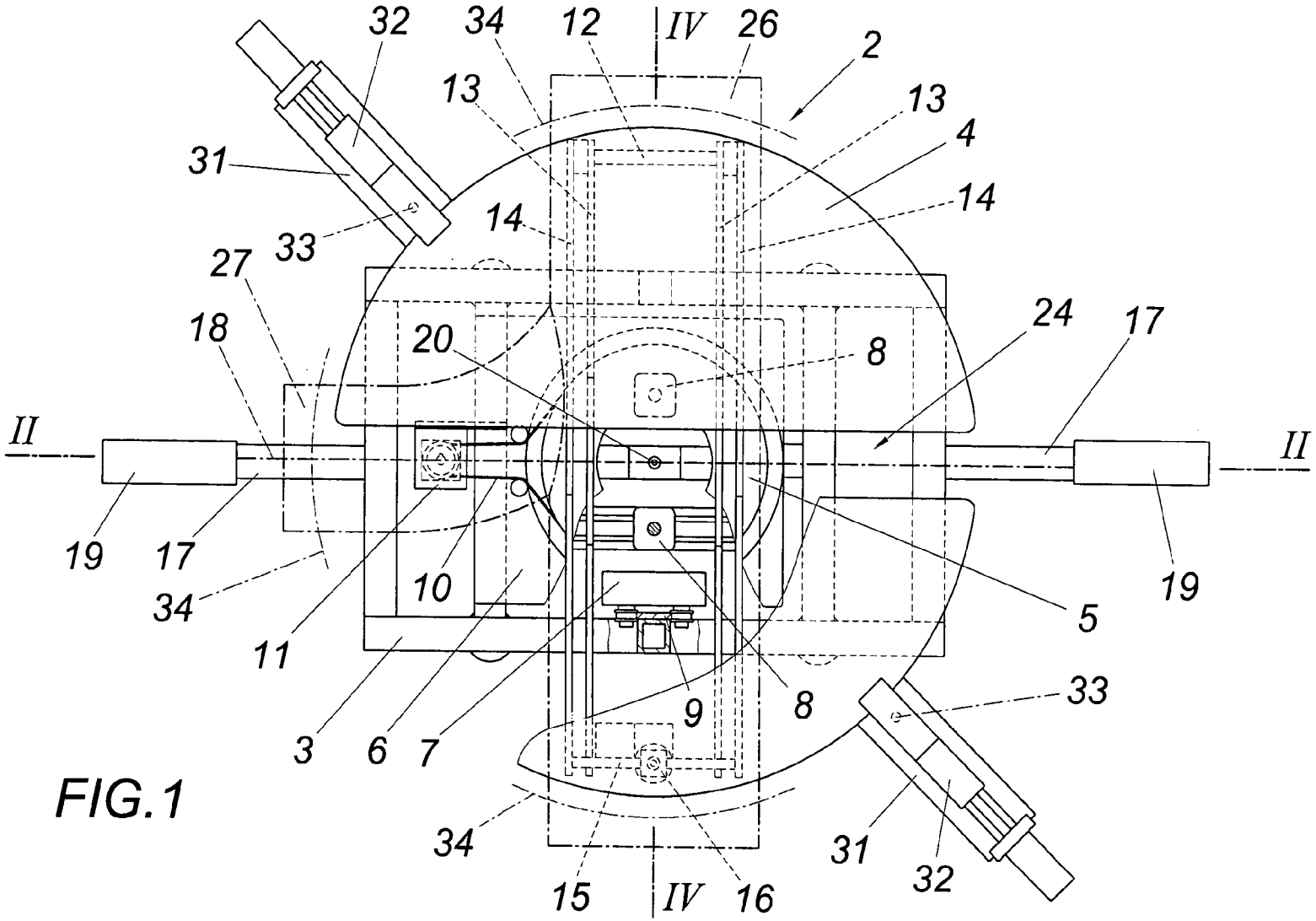
FIG. 1 shows a device according to the present invention for processing the contact surface of a mold profile forming a negative mold for a shaft floor drain in a top view which is partially cut away.

The device shown for processing the contact surface 1 of a mold profile 2 made of thermoplastic foam as a negative mold for a shaft floor drain has a frame 3, which supports a receptacle table 4. This receptacle table 4 is mounted on a stewing ring 5, which rests on guide carriages 7 via a support plate 6. The support plate 6 may therefore be adjusted in height with the aid of a lift unit 8, comprising lift cylinders, for example, along guides 9 for the carriages 7. A toothed belt drive 10, whose drive is identified by 11 and which encloses the slewing ring 5 on the outside, is used to drive the slewing ring 5.

The table 4 for receiving the mold profile 2 is mounted so it is pivotable in relation to the slewing ring 5 around a transverse axis 12. For this purpose, the slewing ring 5 carries two side cheeks 13, on which the table 4 is linked via the pivot axis 12, with the aid of webs 14 enclosing the side cheeks 13. On the ends diametrically opposite the pivot axis 12, the webs 14 are connected to one another via an axis 15, on which a pivot drive 16 situated between the side cheeks 13 engages. As may be seen from FIG. 4 in particular, the inclination of the table 4 may thus be adjusted by actuating the pivot drive 16, in the form of a spindle drive, for example.

Booms 17 are provided on diametrically opposite sides of the frame 3 in relation to the axis of the stewing ring 5 for guying a heating wire 18, which is supported between the end holders 19 on a mandrel 20 coaxial to the slewing ring 5 and forms two branches 21 symmetrical to the mandrel 20, which intersect in the axis of the slewing ring 5. The mandrel 20 is situated on a holder 22, which is attached to a carrier 23 fixed on the frame and penetrates the support plate 6 and the slewing ring 5 in a central opening. The mandrel 20 may be adjusted with the holder 22 on the frame 3 in the direction of the axis of the slewing ring 5 to set the inclination of the heating wire branches 21, which is not shown for reasons of clarity, however. A passage 24 for the heating wire 18 is provided in the table 4, so that the table 4 may be lowered from the starting position shown in FIG. 2 into an operating position shown in FIG. 3, in which the heating wire 18 may be inserted through the table 4 into a processing allowance 25 of the mold profile 2 in the area of the contact surface 1 to be processed. In this insertion position of the table 4 lowered via the lift unit 8, the slewing ring 5 may be rotated via the toothed belt drive 10 around 180°, the two branches 21 of the heating wire 18 cutting the processing allowance 25 of the mold profile 2 away from the mold profile 2 along a conical surface. Accordingly, if the mold profile 2, which is assembled from an extruded profile 26 for the main drain and a profile part 27 for a drain branch, is placed on the receptacle of the table 4 in such a way that the receptacle axis 28, which corresponds to the rotational axis of the stewing ring 5, is coincident with axis of the contact surface 1 to be processed, as shown in FIG. 2, after the heating wire 18 is inserted into the processing allowance 25 as shown in FIG. 3, a conical surface is obtained as the contact surface 1 during the relative rotation between the heating wire 18 and the mold profile 2, which corresponds to the inclination of the branches 21 of the heating wire 18 in relation to the receptacle axis 28.

Figure 4:
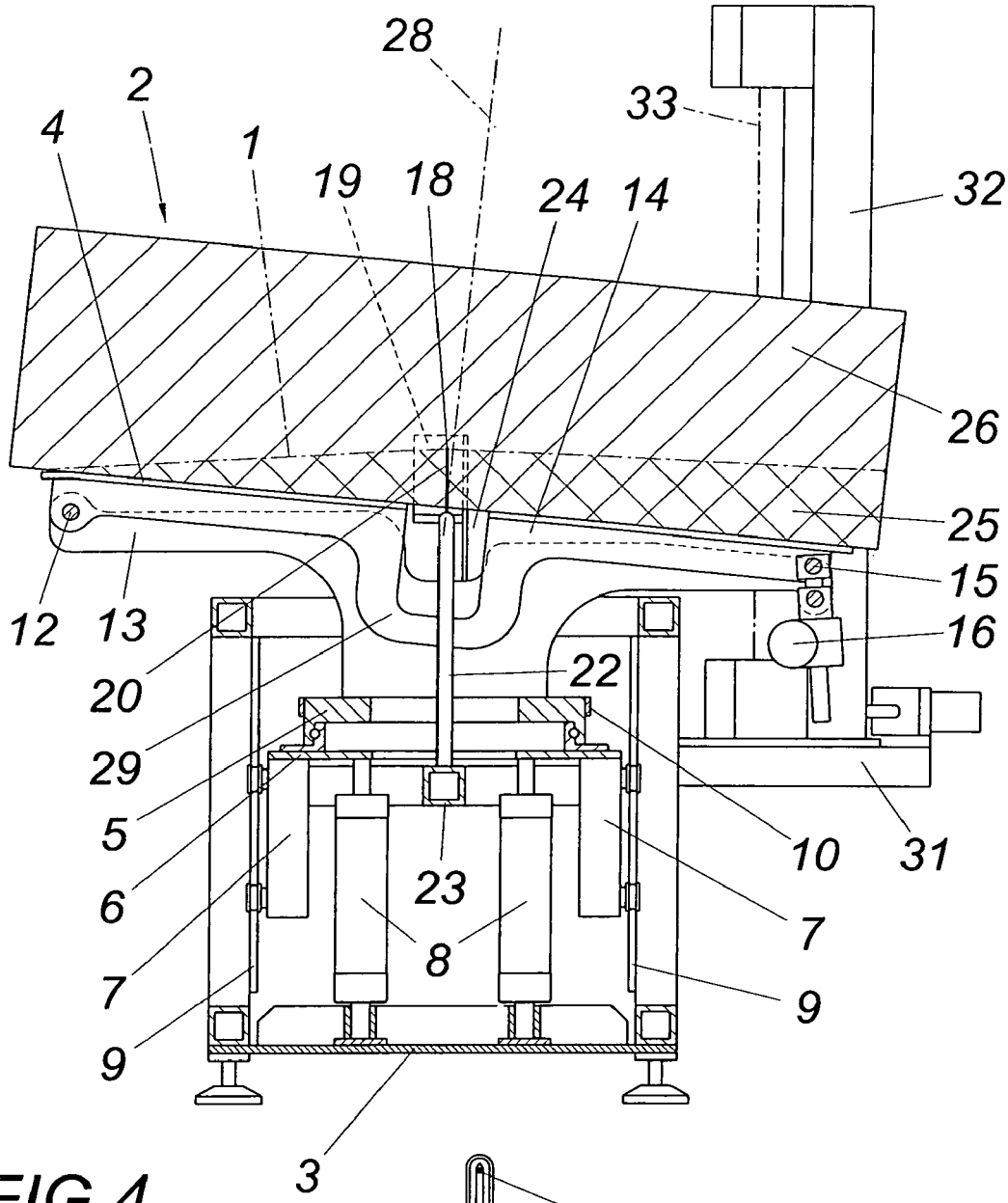
FIG. 4 shows a section along line IV-IV of FIG. 1 in a larger scale.

If an inclination of the conical step surface of the shaft floor to be produced is also to be considered, this inclination of the step surface may be set as shown in FIG. 4 by pivoting the table 4 around the pivot axis 12. An inclination of the receptacle axis 28 in relation to the rotational axis of the slewing ring 5 results with this pivot of the table 4, which is accompanied by a corresponding inclination of the axis of the conical contact surface 1.

Figure 2:
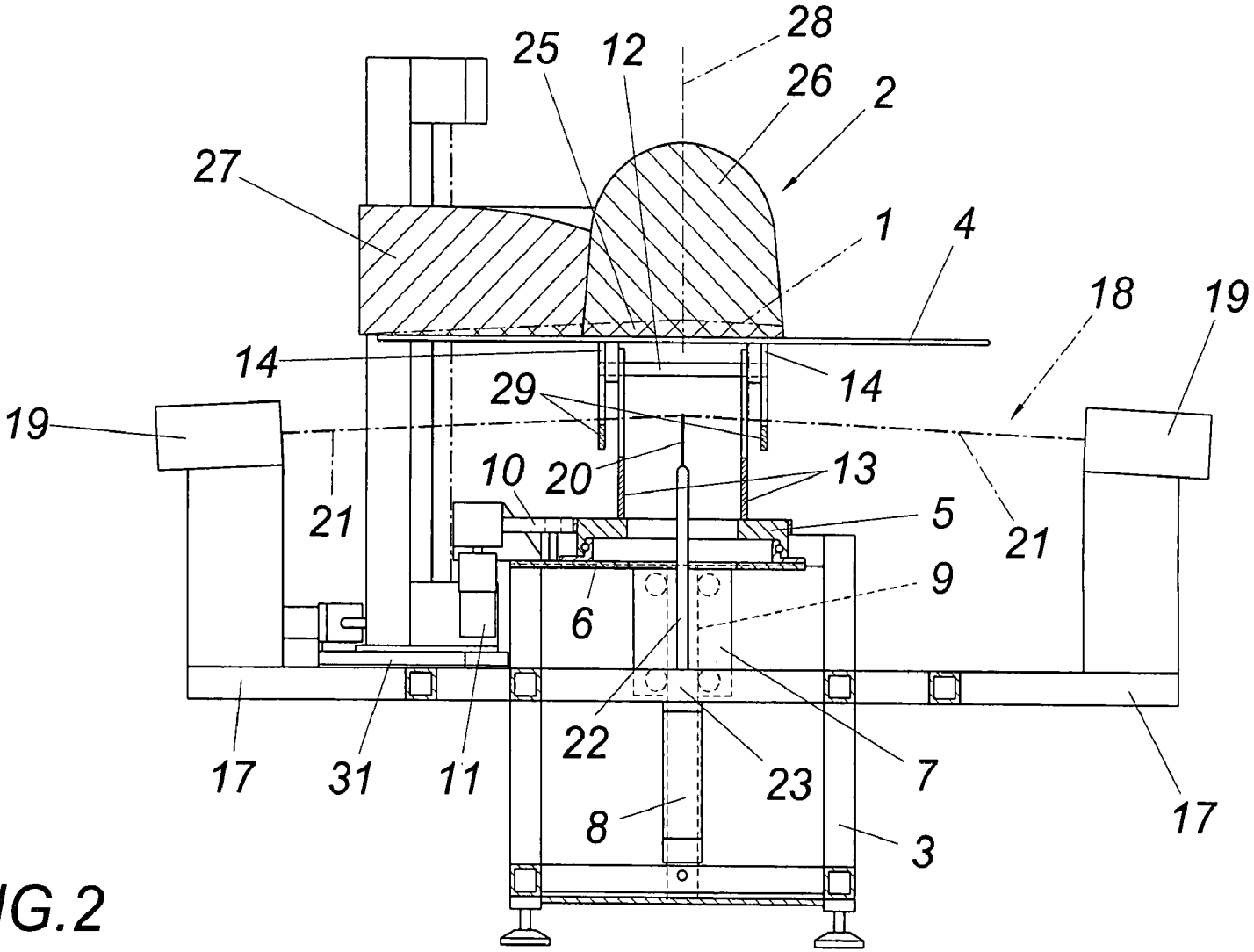
FIGS. 2 and 3 show the device in FIG. 1 in a section along line II-II in two different operating positions.
Figure 3:
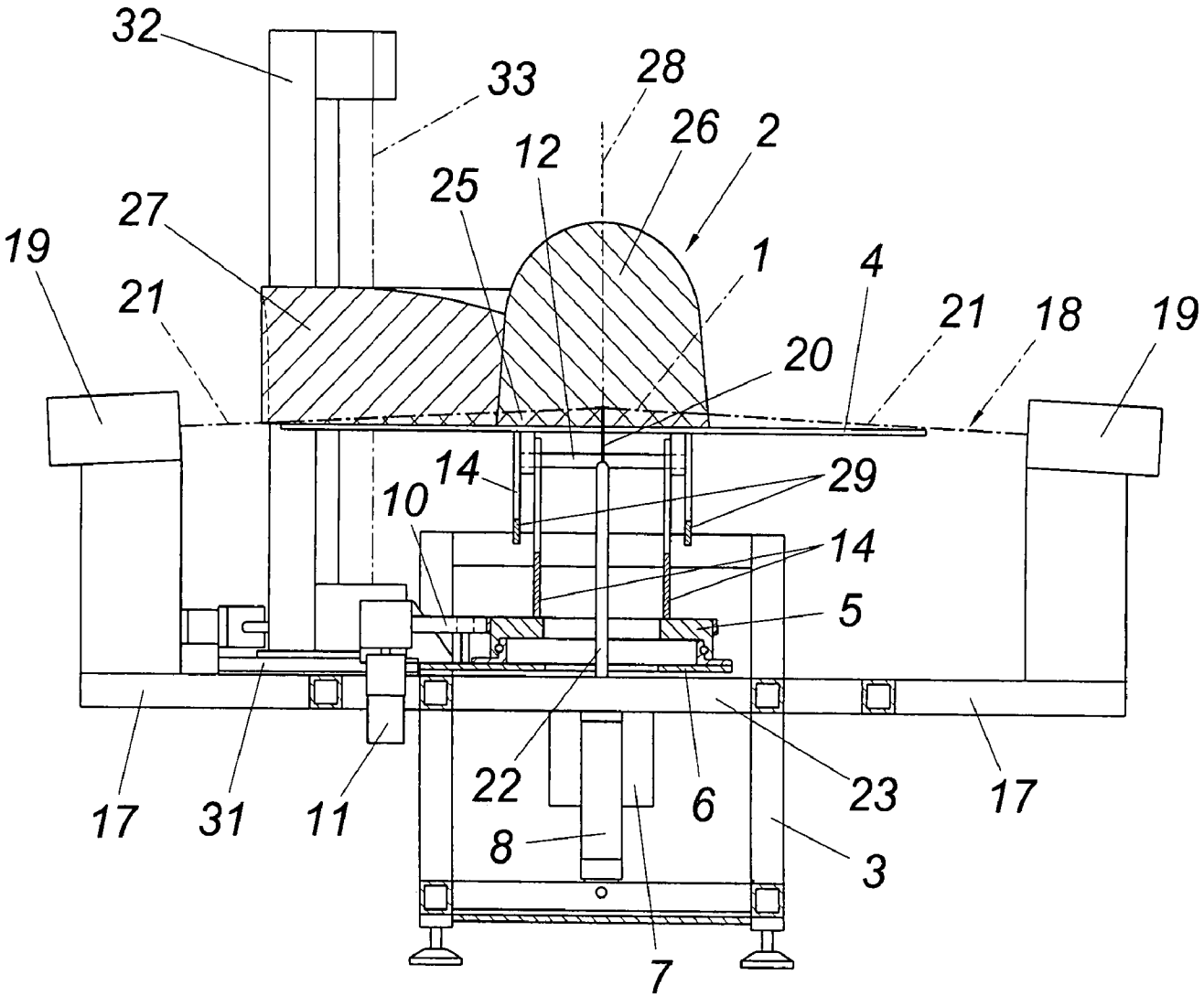

Since the webs 14 which connect the two receptacle parts of the table 4 separated from one another by the passage 24 run transversely to the heating wire 18, these webs 14 must have a bend 29 in the area of the heating wire so that the heating wire 18 runs above the webs 14 even when table 4 is raised, as shown in FIG. 2.

Figure 5:
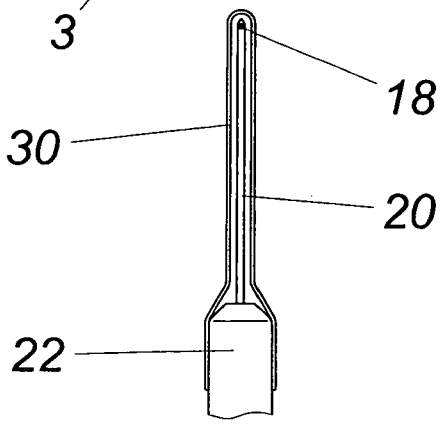
FIG. 5 shows a view of a mandrel for supporting the heating wire in the longitudinal direction of the heating wire in a larger scale.

If the heating wire 18 supported by the mandrel 20 may not melt a sufficient partition line in the processing allowance 25 of the mold profile 2 to insert the mandrel 20 into this melted line, as shown in FIG. 5, the tip of the mandrel 20 may be enclosed by a heating wire clip 30 running transversely to the heating wire to support the heating wire 18, which is then implemented so that the insertion of the mandrel 20 into the processing allowance 25 of the mold profile 2 may be performed without problems.

In order that the mold profile 2 may be processed on its front faces in accordance with the cylindrical surface of the mold core, to whose floor the mold profile is to be applied to produce the shaft floor, additional booms 31 having radially adjustable supports 32 for heating wires 33 running parallel to the rotational axis of the table 4 may be provided on two sides of the frame 3 diametrically opposite to the rotational axis of the slewing ring 5, so that processing of the front faces of the mold profile along an envelope cylinder 34 indicated by a dot-dash line in FIG. 1 may also be performed with the processing of the contact surface 1.

The invention claimed is:

1. A device for processing a contact surface of a mold profile comprising:

(a) a table for receiving the mold profile;

(b) a heating wire extending along the contact surface, said heating wire being movable in relation to the table along the contact surface; and (c) a mandrel extending coaxially to a receptacle axis and supporting the heating wire near the receptacle axis;

wherein the mold profile is rotatable coaxially to the table around the receptacle axis in relation to the heating wire, the heating wire extending from the mandrel at an angle corresponding to the contact surface and diagonally in relation to the receptacle axis; and wherein the table has a passage for insertion of the heating wire into a processing allowance near the contact surface of the mold profile.

2. The device according to claim 1, wherein the table is mounted to be rotatable in a frame in relation to the heating wire.

3. The device according to claim 2, wherein the mandrel is adjustable along the receptacle axis toward the table.

4. The device according to claim 1, wherein the heating wire has two branches symmetrical to the receptacle axis on diametrically opposite sides of the receptacle axis.

5. The device according to claim 1, wherein the mandrel has a tip enclosed by a heating wire clip running transversely to the heating wire to support the heating wire.

6. The device according to claim 1, wherein the mandrel is adjustable along the receptacle axis toward the table.

7. The device according to claim 1, wherein the table is mounted to be pivotably adjustable around a transverse axis to the receptacle axis.

8. The device according to claim 1, further comprising at least one additional heating wire, running parallel to the receptacle axis and held in a carrier, said carrier being adjustable radially to the receptacle axis on the table and is mounted to be rotatable around the receptacle axis in relation to the table.

* * * * *